United States Patent [19]

Burke et al.

[11] Patent Number: 5,027,099

[45] Date of Patent: Jun. 25, 1991

[54] SENSITIVE FAULT DETECTION SYSTEM FOR PARALLEL COIL AIR CORE REACTORS

[75] Inventors: Patrick E. Burke, North York; Richard F. Dudley; Ralph S. Daniel, both of Toronto, all of Canada

[73] Assignee: Guthrie Canadian Investments Limited, Toronto, Canada

[21] Appl. No.: 175,213

[22] Filed: Mar. 30, 1988

[30] Foreign Application Priority Data

Mar. 31, 1987 [CA] Canada ..... 533505

[51] Int. Cl.[5] ..... H01F 27/08; H01F 27/28; H01F 15/10

[52] U.S. Cl. ..... 336/60; 336/65; 336/180; 336/186; 336/192

[58] Field of Search ..... 336/180, 186, 187, 223, 336/60, 185, 207, 192, 65

[56] References Cited

U.S. PATENT DOCUMENTS

| | | | |
|---|---|---|---|
| 873,253 | 12/1907 | MacGahan | 336/186 |
| 1,554,250 | 9/1925 | Woodrow | 336/186 X |
| 2,497,516 | 2/1950 | Phelps | 336/186 X |
| 2,530,995 | 11/1950 | Rumpf, Jr. | 336/186 X |
| 3,225,319 | 12/1965 | Trench | 336/186 X |
| 3,264,590 | 8/1966 | Trench | 336/199 |
| 3,696,315 | 10/1972 | Riggins | 336/207 X |
| 3,902,147 | 8/1975 | Trench | 336/180 X |
| 4,129,846 | 12/1978 | Yablochnikov | 336/223 X |

FOREIGN PATENT DOCUMENTS

| | | | |
|---|---|---|---|
| 1233943 | 2/1967 | Fed. Rep. of Germany | 336/180 |

*Primary Examiner*—Thomas J. Kozma

*Attorney, Agent, or Firm*—Stanley E. Johnson

[57] ABSTRACT

An air core reactor of the type having a plurality of coaxial coil windings connected electrically in parallel by structurally rigid spiders at opposite ends of the reactor. There are two electrically conductive spiders at least one end of the reactor. Selected ones of the coil windings are connected to one of the two spiders and further selected ones of the coil windings are connected to the other of the spiders at the one end. In the preferred form the windings connecterd offset from one another around the coaxially disposed coils. In a further preferred embodiment, there are two electrically conductive spiders at each of opposite ends of the coaxial coils. In a still further preferred form, at least some of the coil windings are wound at least two conductors high with the same number of turns and wherein the ends of said two conductors are circumferentially offset from one another by preferably 180°. In the most preferred form all coil windings are wound at least two conductors high ("n" high where "n" is an even number). The two spiders at one end may be a single structural unit with two separate electrically conductive spiders mounted thereon and carried thereby, or they may be two separate rigid electrically conductive structures that are internested or stacked one on top of the other. The two spiders at each of the opposite ends and the coil windings connected in parallel with the connections offset circumferentially provides a coil arrangement which can be checked readily for faults which are even relatively minor in nature or the detection of such faults in an operating system can be used to initiate a shut down of the system or parts thereof before substantial damage takes place.

17 Claims, 9 Drawing Sheets

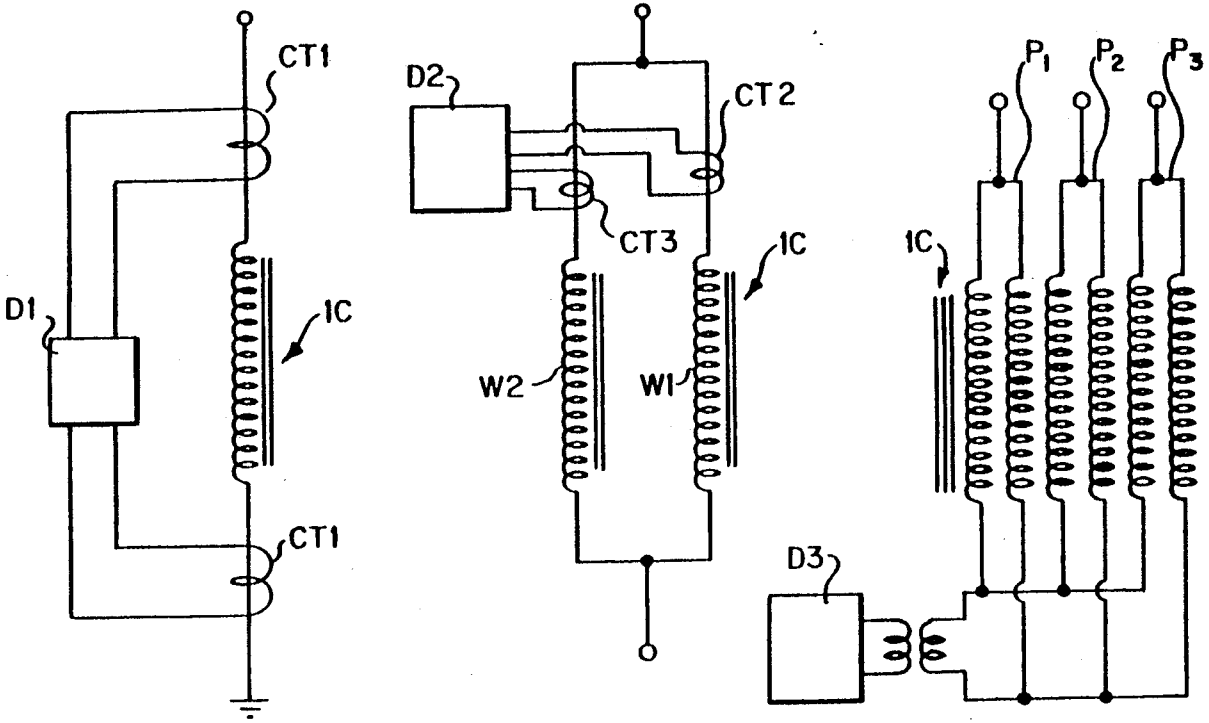
FIG. Ia
FIG. Ib
PRIOR ART
FIG. Ic

SENSITIVE FAULT DETECTION SYSTEM FOR PARALLEL COIL AIR CORE REACTORS

FIELD OF INVENTION

This invention relates to an improved air core reactor and improvements in protection schemes for detecting faults in air core reactors and in particular for air core reactors which consist of a large number of coaxial coil windings electrically connected in parallel. The invention is particularly directed to a method of detecting electrical faults in air core reactors and to the construction of air core reactors which permits carrying out such method. The detection of faults of the present invention is applicable to single-phase reactors having more than one paralleled layer and to 3-phase banks of such reactors and to 3-phase VAR reactor banks. Although the protection scheme is most effective with reactors in which all layers are wound 2-high (or n-high where n is an even integer), it can also be used for protecting 1-high reactors, but with a reduced sensitivity.

The size of air core reactors used on large power systems has grown steadily and it is quite common today to use reactors rated 50 MVA and larger. In addition, these reactors are often employed in conjunction with other apparatus such as for VAR control, where a serious fault in the reactor can allow excessive rate of change of current through the thyristors resulting in serious damage to the expensive solid state components of the system. It is therefore very important to be able to identify faults in reactors at an early stage and to take appropriate actions before either the reactor or other components in the system are damaged.

The problem is especially difficult for multi-layer paralleled coil reactors where the initial fault may be so small that it cannot be detected by conventional means. The system proposed herein has the following advantages over existing systems: (1) it can detect faults in the finished reactor before it leaves the factory which would be undetectable otherwise; (2) it is able to detect initial faults in reactors in the field long before other protection schemes could detect them and thus to allow appropriate actions to be taken to prevent serious damage to the coil and to other connected equipment; (3) the new fault detection system also makes it very simple to diagnose the problem in the field and to establish exactly where the fault has occurred. This may allow repairs to be made in the field and if not, allows the unit to be shipped back to the factory to be repaired at minimum cost.

BACKGROUND OF THE INVENTION

The simplest fault detector employed in electrical apparatus is the simple impedance relay which continuously calculates the ratio of voltage across the apparatus to current through it. When a fault occurs, the impedance of the apparatus changes and the fault detector registers a fault. The problem with this protection system is that it is not very sensitive and when applied to air core reactors simply cannot detect the small faults which can occur in these devices.

Differential protection systems have been applied very successfully to iron cored electrical apparatus like generators, transformers and iron cored reactors. Current transformers at either end of the apparatus compare the currents entering and leaving the winding. When a ground fault occurs, the current leaving is not equal to the current entering the winding and the detector registers a fault. Winding to ground faults cannot easily occur on an air cored winding and therefore the system is not useful for air cored reactors.

In another known differential relaying system, useful to protect electrical apparatus in which the winding comprises two identical halves connected in parallel, current transformers continuously compare the currents in two halves of the winding and when a fault occurs in either winding the resulting imbalance in currents produces a detector signal which signifies that a fault has occurred. The difficulty with this scheme when applied to any air core reactor is that it is unable to detect a turn to turn fault in many reactors, particularly in those reactors which consist of a very large number of windings in parallel.

In a variant of the preceeding, a single detector is used to detect a fault in any one phase of a three phase system. It works in essentially the same manner as the preceeding system, but in this arrangement a single detector is able to detect when a fault occurs in any one of the three windings of a three phase device. When applied to air cored reactors, the system suffers from the same limitations as the preceeding system, namely that it is not sensitive enough to detect turn to turn faults in many air cored reactors even though these turn to turn faults can quickly cause extensive damage to the reactor and often to other devices to which the reactor is connected.

The system to be described in the next section overcomes at least some of these limitations and is able to detect the smallest of faults in air core reactors, and furthermore has the decided advantage that the detector current is directly proportional to the severity of the fault that has occurred.

SUMMARY OF THE INVENTION

The present invention is concerned with the construction of and the protection of large air core reactors of the type, for example, described in applicant's U.S. Pat. No. 3,264,590 issued Aug. 21, 1966, which comprise a large number of coupled, concentric, helical windings, all of which are connected in parallel. The invention comprises two principal parts: (1) an arrangement of the paralleled helices such that any internal conductor to conductor fault causes a large and known portion of the fault current to flow out the terminals of the faulted winding. This is in sharp contrast to the case of a conventional coil where a very large short circuit current may exist internally within a single turn while at the same time producing a very small change in the external current to the reactor; (2) special means for connecting all of the paralleled helices together at at least one end and preferably both ends of the reactor such that sensitive detection means can be used to detect the presence of a fault and furthermore to detect the magnitude of the fault current.

In accordance with one aspect of the present invention, there is provided an air core reactor comprising a plurality of coaxial coil windings, an electrically conductive and structurally rigid first spider at one end of said coil windings and two electrically conductive second and third spiders at the opposite end of said coil windings, said coils being connected to said spiders such that the coil windings are electrically in parallel, selected ones of said coil windings being connected to said second spider and further selected ones of said coil windings being connected to said third spider. In one preferred form the windings that are connected to said second spider are connected thereto at a position circumferentially offset around the coaxial coils from where the further selected coils are connected to the third spider. In a still further preferred embodiment, there are two electrically conductive spiders at each of opposite ends of the coaxial coils. In a still further preferred form, at least some of the coil windings are wound at least two conductors high with the same number of turns and wherein the ends of said two conductors are circumferentially offset from one another. Preferably the offset is 180°. The two spiders at one end may be a single structural unit with two separate electrically conductive spiders mounted thereon and carried thereby, or they may be two separate rigid structures that are internested or stacked one on top of the other.

LIST OF DRAWINGS

The invention is illustrated by way of example in the accompanying drawings, wherein:

FIGS. 1*a*, 1*b* and 1*c* are schematic drawings of prior art devices;

FIG. 2*a* is a side diagrammatic view of an air core reactor provided in accordance with the present invention;

FIG. 2*b* is a bottom view of FIG. 2*a;*

FIG. 2*c* is a diagrammatic and schematic drawing of the upper end of the reactor, of FIG. 2*a* illustrating applicant's invention in its simplest form;

FIG. 3*a* is a schematic illustration of a reactor with n-packages of coil each of which comprises two interwoven helices;

FIG. 3*b* illustrates schematically a minor variation to the system of FIG. 3*a;*

FIG. 4 is a circuit representation of the coils schematically illustrated in FIG. 3*a;*

FIGS. 5*a* and 5*b* are elevational partial views part in section illustrating constructional details of the spider arms used to connect the coil windings of the reactor in parallel;

FIG. 5*c* is a view of the encircled portion of FIG. 5*b* on a larger scale;

BRIEF DESCRIPTION OF PRIOR ART

FIGS. 1*a*, 1*b* and 1*c* are illustrative of prior art fault detection systems referred to herein in the introductory portion. These systems are applicable to and successful with iron core electrical induction apparatus designated generally by the reference 1*c*. In the system of FIG. 1*a*, a current transformer CT1 is located at each of opposite ends comparing current entering and leaving the winding which registers on detector D1. In FIG. 1*b* the winding comprises two identical halves designated W1 and W2 with the currents therein monitored by respective current transformers CT2 and CT3, and any fault is indicated by detector D2. FIG. 1*c* illustrates three phases designated respectively as P1, P2 and P3 with a single detector D3 which detects a fault in any one of the three phases. As previously indicated, these previously known fault detector systems have limitations or are unsuitable with respect to detecting faults in air core electrical induction apparatus of the type having multi coils connected in parallel.

DESCRIPTION OF PREFERRED EMBODIMENTS

The present invention is applicable to air core reactors of the type described, for example, in the aforementioned U.S. Pat. No. 3,264,590, or by way of example disclosed in U.S. Pat. No. 4,471,337, Sept. 11, 1984 to J. Mausz, or U.S. Pat. No. 3,991,394, issued Nov. 9, 1976 to A. M. Barnwell, et al.

Disclosed in these patents are air core reactors which comprise a number of concentrically disposed coil layers located between a pair of end spiders. The end spiders not only provide structural support for the unit, but also are used to connect the coil layers electrically in parallel and provides for having coil windings with fractional turns.

Figure 2A:
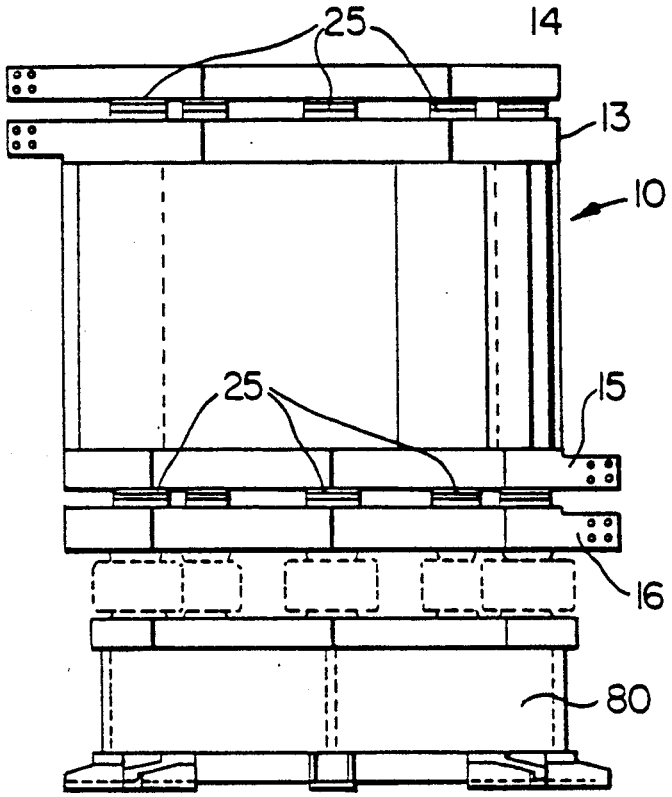
Figure 2B:
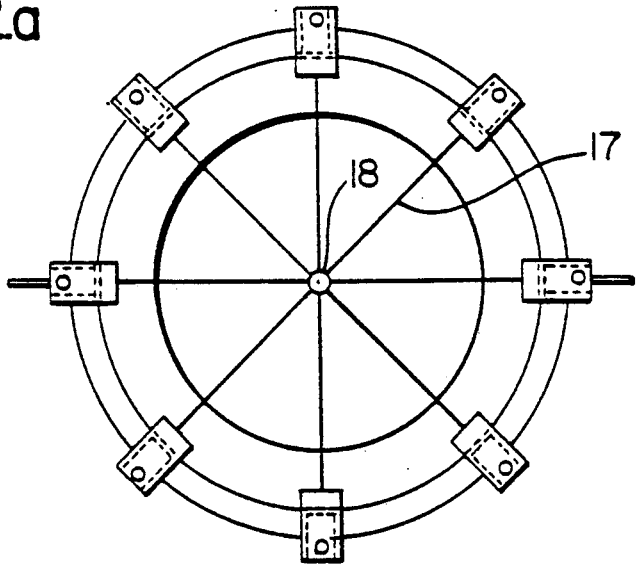
Figure 2C:
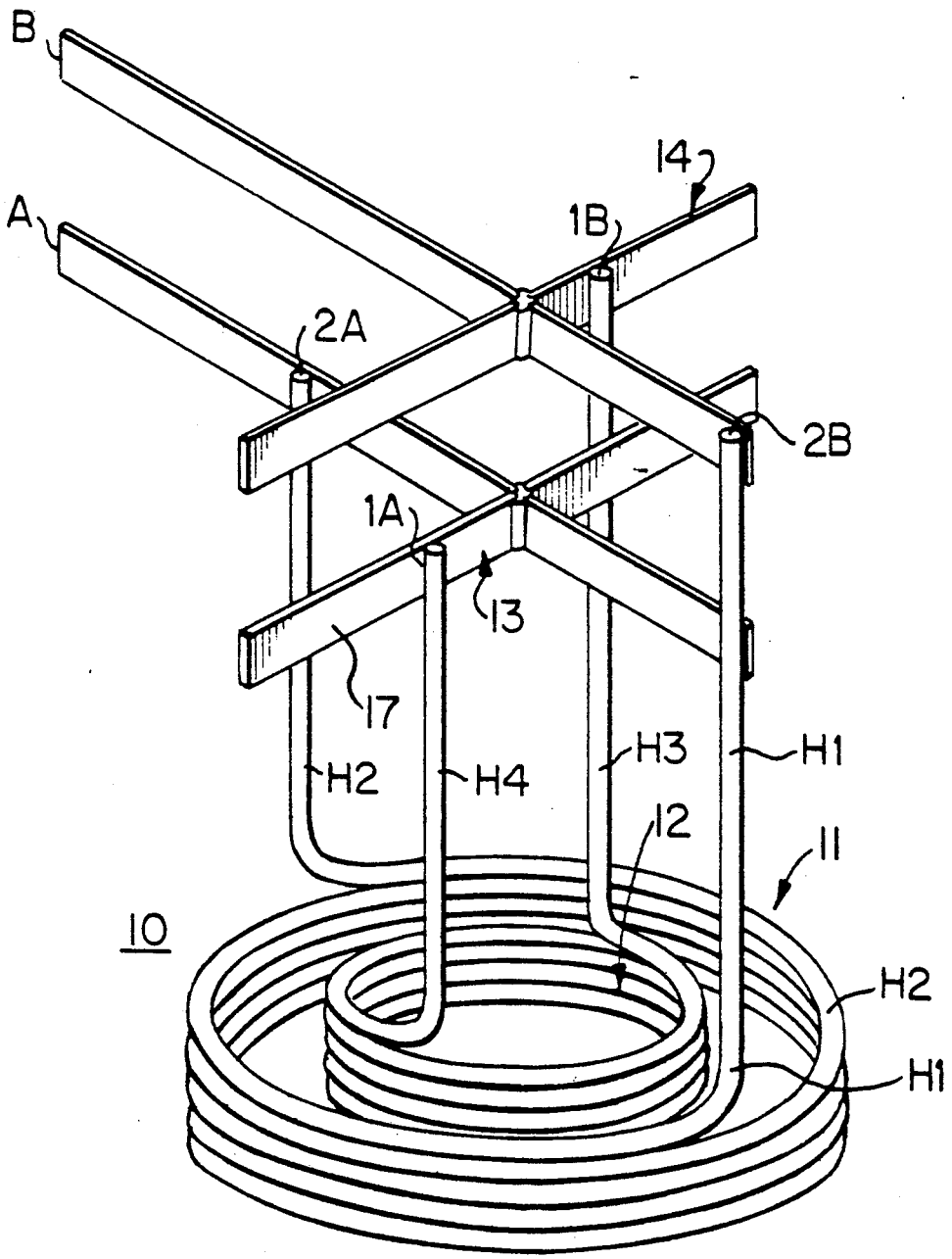

FIG. 2*c* is a diagrammatic view of the upper end of the reactor 10 shown in FIG. 2*a*. The coil of the reactor comprises two coil packages designated 11 and 12 each containing two identical interwoven helices. Coil 11 has helices, i.e. helical windings H1 and H2, and similarly coil 12 has helical windings H3 and H4. Windings by way of example H1 and H2 are wound at the same time and thus are referred to herein as interwoven helices. They also may be referred to as being two high and there may be any number n where n is an even number. Coils 11 and 12 illustrated are each a single layer coil and further layers may be tightly wound thereon. The helices may be wound using a single conductor or a composite conductor comprising a number of insulated and transposed sub-conductor. For the moment it will be assumed for simplicity that the helices each comprise a single conductor. The top ends of the two interwoven helices H4 and H3 comprising the inner package 12 are terminated on the arms of two separate spiders 13 and 14 at points designated respectively 1.A and 1.B. It will be noted that the terminations are made 180° apart, i.e. offset circumferentially from one another. The top ends of the two helices H2 and H1, comprising the outer package 11, are also terminated 180° apart on the two separate spiders 13 and 14 at points designated respectively 2.A and 2.B. Although not shown in FIG. 2*c*, it is assumed that the bottom ends of the helices are also connected to the bottom pair of spiders 15 and 16 (see FIG. 2*a*) in a manner symmetric to that shown for the top ends in FIG. 2*c* such that the two interwoven helices of the inner package have precisely the same number of turns and the two interwoven helices of the outer package have precisely the same number of turns. As a result of terminating the ends of the helices as described and illustrated, the four helices H1, H2, H3 and H4 are in two parallel groups, one group containing helix H4 of the inner package and helix H2 of the outer package, and the second group containing helix H3 of the inner package and helix H1 of the outer package. In order to connect all helices in parallel it is only necessary to connect terminals A and B of respective spiders 13 and 14 together at the top of the reactor providing a single connection X to line (see FIG. 3*a*) and the corresponding two spiders 15 and 16 together at the bottom of the reactor providing single connection Y to line. Although only two packages are shown, any number of packages may be used to comprise a reactor. Similarly, although only two interwoven helices are shown in each package, any even number of interwoven helices may be used in any package, alternate helices being terminated on one spider and the rest of the helices terminated on the second spider. Each spider 13, 14, 15 and 16 has a plurality of arms 17 (any number as may be desired) radiating outwardly from a central hub 18. Spiders 13 and 14 at one end may be separate structurally and stacked as illustrated by way of example in FIG. 2*a*, or be structurally integral as described hereinafter with reference to FIGS. 6A and 6B.

Figure 3A:
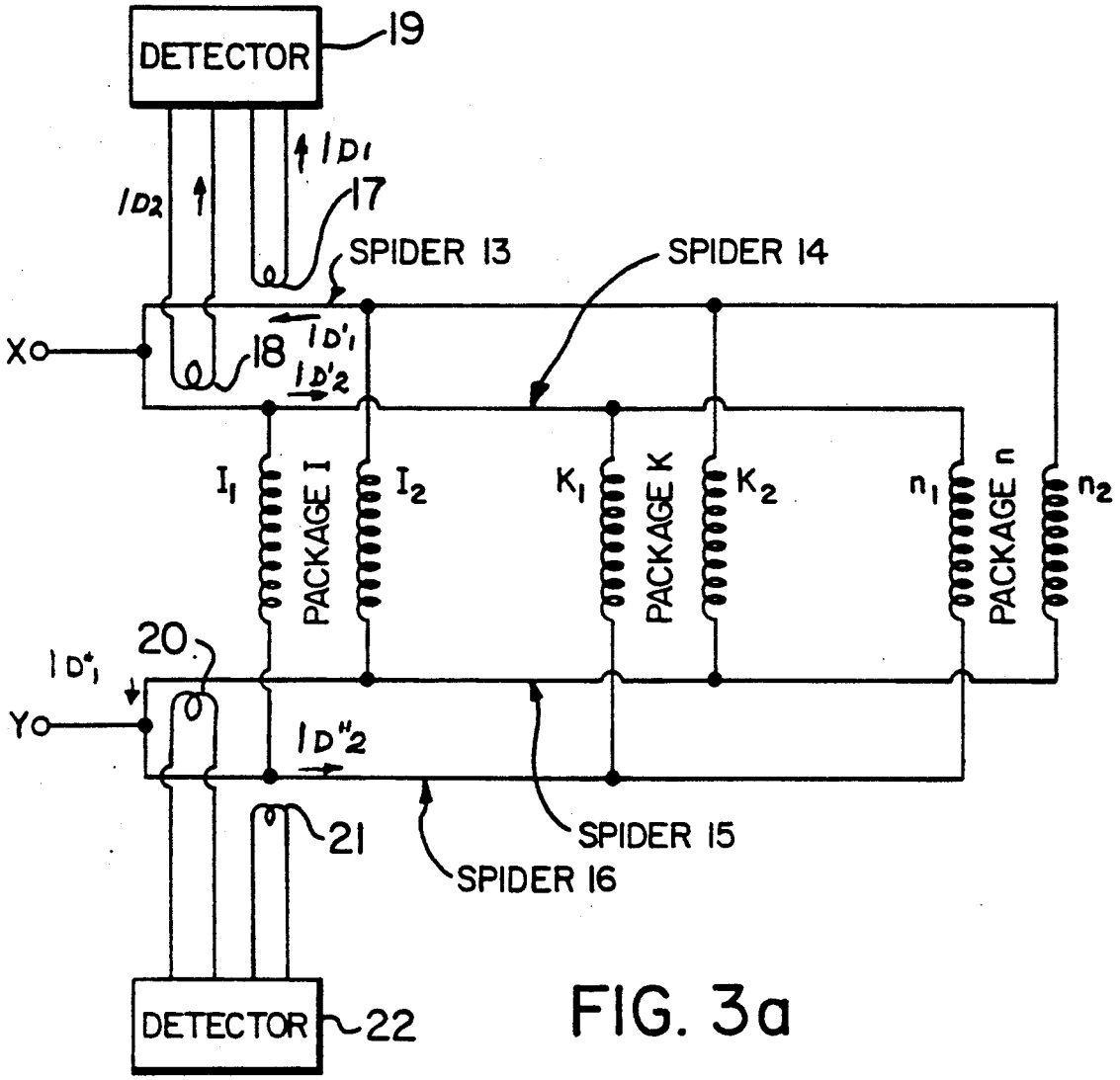
Figure 3B:
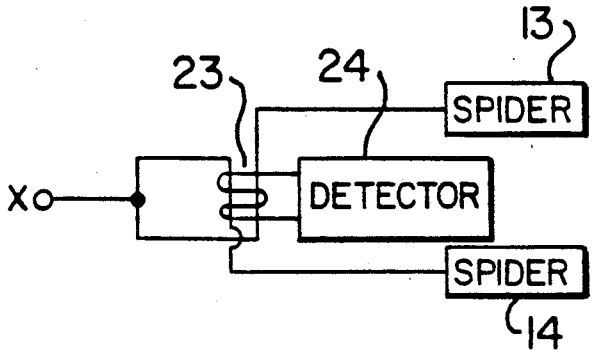

FIG. 3*a* is a circuit schematic of an n-package reactor, n representing the last in any number of packages, and wherein each package comprises two interwoven helices as shown or more if desired. In FIG. 3*a* the three packages are designated l, k and n and two interwoven helices are shown side-by-side for convenience, helices 11, 12 of package l, helices k1, k2 of package k, and n1, n2 of package n. By way of example, helices 11, 12 are equivalent to helices H1 and H2 of package k of FIG. 2*c*. As shown in FIG. 3*a*, the two interwoven helices in each package are connected to separate spiders 13 and 14 at the top end and to separate spiders 15 and 16 at the bottom end. In FIG. 3*a* the current in each of the individual spiders is measured by current transformers as shown in the sketch and the detectors shown measure the difference between the two currents in the spiders at each end. Spiders 13 and 14 at the top have associated therewith respective current transformers 17 and 18 connected to detector 19. Spiders 15 and 16 similarly are associated with respective current transformers 20 and 21 connected to a detector 22. The two top spiders 13 and 14 are connected by a single upper line terminal X while the two lower spiders are connected together at a single lower line terminal Y. Although FIG. 3*a* shows the use of two separate current transformers at each end of the coil in order to find the difference between the currents in the spiders at each end, it is possible to use a single differential current transformer 23 and detector 24 at each end which measures directly the difference in the currents of the two halves of the spider as shown in FIG. 3*b*. The arrangement 15 and 16 of FIG. 3*a*.

If the reactor shown in FIG. 3*a* is now energized by connecting terminals X and Y to a source, then the two conductors in each layer will carry precisely the same value of current since they are perfectly symmetrical and the total voltage induced in each of the helices in a layer is identical when the reactor is energized. Also, the voltage stress per turn is shared equally among the two conductors in a layer, that is, the voltage stress between adjacent conductors is exactly one half what it would be if the layer comprised a single conductor only. The exact voltage between two adjacent conductors in a layer depends upon: (1) how many layers there are in the reactor and on the exact location of the particular layer (the outer layer of the reactor links more flux than the inner layer of the reactor and therefore, the voltage between adjacent conductors in the outer layer is larger than the voltage between adjacent conductors in the inner layer); (2) the location of the two adjacent conductors in the layer (i.e. are the two conductors near the middle of the reactor or near one end). Since the turns at the end of the reactor link approximately 10 to 30 percent less flux than a turn to the centre of the reactor, the voltage between adjacent conductors at the end of the reactor is from 10 to 30 percent less than the voltage between adjacent conductors at the centre of the reactor. If a fault occurs due to two adjacent conductors touching in any layer,(for example in layer k), the voltage difference which previously existed between the two conductors (namely half of a turn voltage), disappears and is replaced by a fault voltage E, which forces unbalanced currents within package k as shown in the circuit diagram of FIG. 4.

Figure 4:
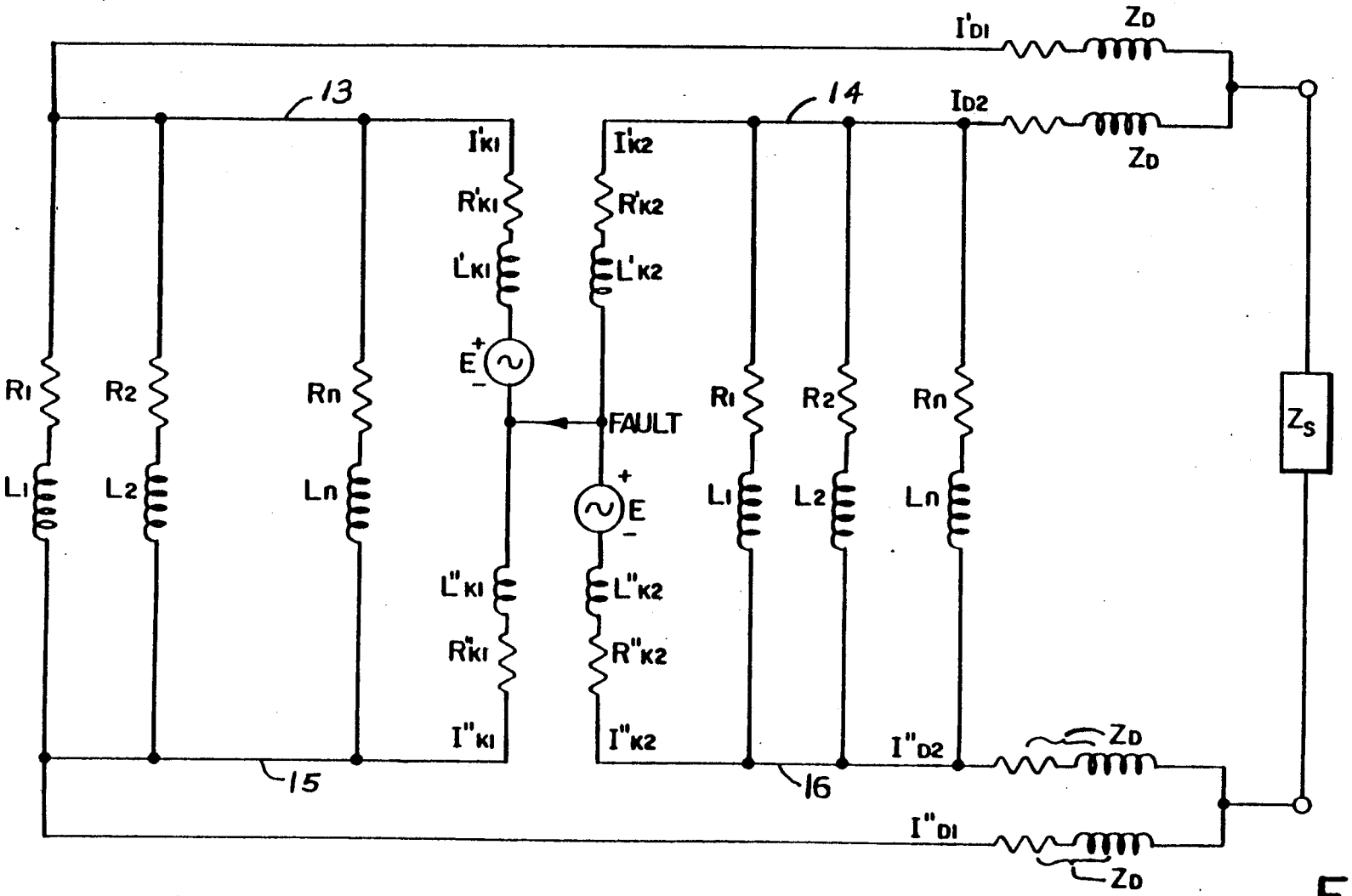

FIG. 4 is a circuit representation of the coil which is shown schematically in FIG. 3*a*. The two helices k1 and k2 of package k are shown alongside each other with a fault depicted between them. The fault divides both of the helices k1 and k2 of package k into upper and lower parts as shown and injects a fault voltage (the voltage which existed between the adjacent turns before they touched) into the upper end and lower parts of the package as shown. Subscript k1 refers to one of the helices of winding k, while the subscript k2 refers to the other helix of winding k. The superscript prime denotes the upper half of both helices in package k, while the superscript double prime denotes the lower halves of the two helices of package k. The symbol R denotes the resistance of a winding and the symbol L denotes the self-inductance of a winding. Although all inductances in the circuit are coupled, the coupling is not shown-for simplicity. layers are not shown alongside each other, but rather one of the helices of each winding is shown on the left of the diagram and the other helix is shown on the right of the diagram. The impedances $Z_D$ shown in the upper and lower spiders represent the impedance of the detecting circuit reflected back into the spiders. The symbol $Z_S$ refers to the source impedance of the system into which the reactor is connected.

As was mentioned above, when two adjacent conductors in a package touch this forces the two helices of the package to have a common voltage at that point and simultaneously inject a fault voltage equal to the former voltage between the unfaulted conductors, E, into the upper and lower parts of package k. These fault voltages cause the currents to be perturbed in all parts of the circuit, particularly in the spider arms themselves causing a detector current in the differential current transformers located at the upper spiders and lower spiders of the reactor.

The magnitude of the unbalanced currents due to the fault can be calculated from FIG. 4 using super-position, i.e. by simply neglecting the ordinary load currents produced by the system voltage which is applied to the reactor. The magnitude of this fault voltage E changes very little (less than 30%) with the location in the package, however the currents which result from the fault voltage depend critically on where the fault occurs. If the fault occurs at the mid plane of the reactor, the fault current is limited by the impedances of the upper and lower halves of the helices comprising winding k and the fault current is a minimum. On the other hand, if the fault occurs very close to the upper spider, then the fault currents injected into the upper spider, namely $I_{k1}$ and $I_{k2}$ are very large since the impedances limiting them are very small, while the fault currents flowing from the lower spider, namely $I_{k1}$ and $I_{12}$ are very small. As may be seen from FIG. 4, the detector current at the upper spider (13) is proportional to the difference between the currents in primaries of the two current transformers (17, 18), $I_{D1}$ minus $I_{D2}$ while that at the lower spider detector is proportional to $I_{D1}$ minus $I_{D2}$. The relationship between the detector current and the fault current depends on how much of the fault current leaving the faulted winding k reaches the current transformer detector circuit. Some of the fault current finds its way into the other unfaulted packages in the reactor.

The previous discussion was based on the assumption that each helix in layer k comprised a single conductor. In the case where the two helices in layer k are each wound from a cable comprising "m" insulated and transposed subconductors, each of the interwoven helices in layer k may be treated as m identical paralleled helices. If the initial fault involves only one sub-conductor of each helix, the winding k, shown in FIG. 4, may be taken to comprise only the two subconductors which are in contact and the other (m−1) subconductors in each helix may be lumped in with the other unfaulted helices represented by the subscripts other than k.

An example will now be given to show the relationship between the fault current (herein assumed to be a bolted fault) and the detector currents for a typical reactor.

The advantages of the new fault detection system may be shown by comparing the protection that is available on a large air core reactor with and without the new system. The reactor chosen for the comparison is rated 25 MVA, 60 Hz, 1775 ampere. It comprises eleven concentric packages separated by cooling ducts for natural convection cooling. Each package consists of two, identical, interwoven helices wound from cable which comprises a number of transposed, insulated, sub-conductors. The two interwoven helices of each package are connected to separate spiders at the top and at the bottom of the reactor. Referring to FIG. 4, it has been assumed that the source impedance is 0 ohms (it is easily shown that assuming the source impedance to be infinity makes very little difference in the detector currents). The equivalent impedance of the detector circuit, $Z_D$, reflected back into the spiders has been assumed to be 0.001 ohms. (The value of the detector impedance also makes very little difference to the size of the currents flowing in the detector circuit).

TABLE 1

| Fault Type | Rated Conductor Current Amps | Faulted Conductor Current Amps | Top Spider Detector Current Amps | Bottom Spider Detector Current Amps | % Change in Impedance of Terminals X & Y |
|---|---|---|---|---|---|
| Case 1 | 4.4 | 6.6 | 6.6 | 6.6 | ~0 |
| Case 2 | 35 | 53 | 53 | 53 | ~0 |
| Case 3 | 4.4 | 193 | 368 | 15 | 0.01 |
| Case 4 | 35 | 1394 | 2650 | 108 | 0.1 |

Table 1 compares the current which flows in the faulted conductors, the current which flows in the top and bottom detector circuits and the overall change in terminal impedance of the reactor for four different faults. All faults are assumed to occur on the innermost package and four cases are considered: (1) A fault between adjacent conductors at the mid-plane of the inner package which involves one single conductor from each of the interwoven helices. This is the minimum fault which can occur in the reactor and the one most difficult to detect; (2) this case is similar to case 1 except that the fault is assumed to involve eight conductors from each of the cables comprising the two interwoven helices. This might correspond to the case where the simple fault of case 1 had been allowed to develop, spreading to other conductors in the two cables involved in the fault; (3) a fault between the cables one turn from the top of the inner package. The fault is again assumed to be confined to a single conductor in each of the interwoven helices and is therefore the minimum fault which can occur at this location; (4) this fault is like case 3 except that the fault has been assumed to have developed until it involves eight conductors from the cables comprising each of the interwoven helices.

It will be seen that the minimum possible fault, case 1, produces detector currents of 6.6 amps in both the top and bottom detectors which are 0.4 percent of the rated coil current. This fault level is easy to detect and in any case the sensitivity can be doubled by adding together the signals from both the top and bottom detectors. It will also be seen that the percent change in terminal impedance due to the fault of case 1 is much too small to be detectable. The case 2 fault, which is identical to the case 1 except that it involves eight times as many conductors, produces detector currents that are roughly eight times as large and are very easily detectable by the new detector circuit. It will also be seen that despite the increase in the level of the fault current the percent change in terminal impedance is still below the level of detectability. The case 3 fault is very close to the top end of the reactor and the fault current now has to flow through only a very small amount of conductor before it reaches the top spiders. It will also be seen that the current in the top detector, which is close to the fault, is very large indeed (approximately twice the level of the fault current in the conductor) while the detector current in the bottom detector is very much smaller although it is still well above the threshold of detectability. Once again, despite the large size of the fault current in the faulted conductor, the percent change in terminal impedance is very small, in fact so small that it would be difficult to detect.

The case 4 fault is identical to the case 3 fault except that it now involves eight times as many conductors from each of the helices and therefore the level of the fault current in the cable is very large. This produces a detector current in the top conductor and the top detector which is larger than the rated current of the reactor. The detector current in the bottom detector, which is remote from the fault, is also quite large and easily detectable. Once again, despite the extremely large size of the conductor fault current, the percent change in terminal impedance is quite small and would not be easy to detect.

It is also instructive to compare the cases just considered with the case of a reactor in which each package comprises a single helix. If exactly the same amount of conductors were used and the same size cable, the resulting reactor would have an inductance which is four times as big and a current rating which is only half as big given an MVA rating which is identical to the case already considered. Calculations show that a fault in the mid-plane of the inner package comprising a single conductor would produce a fault current in that conductor of 2900 amperes, which would quickly melt the conductor and spread the fault. However, the change in terminal impedance due to this fault would be only 0.11%, which would not likely be detectable at the terminals. Thus an impedance type of protection would be of little use in protecting such a coil.

CONSTRUCTION OF THE DOUBLE SPIDERS

Figure 5C:
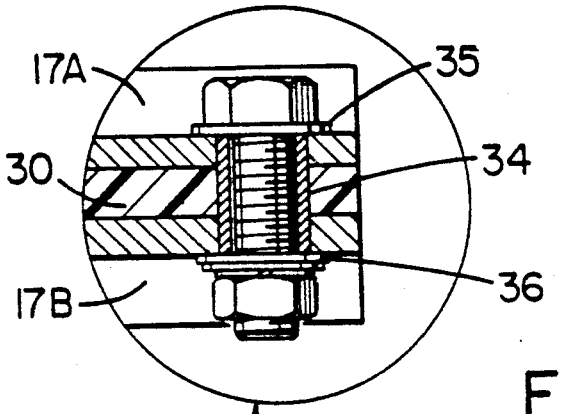
Figure 5B:
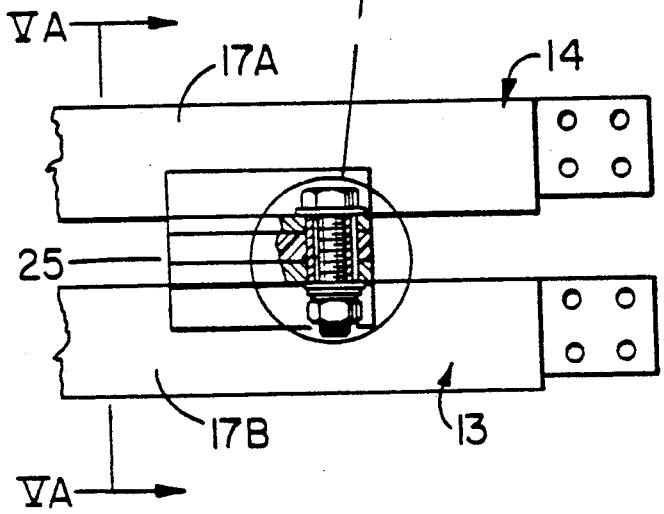
Figure 5A:
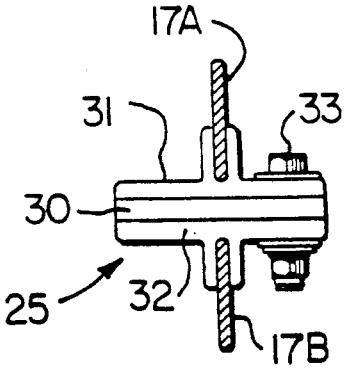

FIG. 2*c*, which shows the general layout of a simple embodiment of the protection system also shows the simplest arrangement of the double spider, namely two identical spiders, one above the other. The two spiders must be insulated electrically from each other (although the voltage between them is never more than a few volts), without compromising the structural integrity of the overall assembly. FIGS. 5*a*, 5*b* and 5*c* show one of a plurality of support structure 25 for joining together spiders 13 and 14 at the top of the unit and spiders 15 and 16 at the bottom. Support structure 25 is shown in these figures between adjacent arms 17A and 17B of the two spiders 13 and 14. FIG. 5*a* is a vertical sectional view along line X—X of FIG. 5*b*, and illustrates a fibreglass pad 30 between brackets 31 and 32 welded to the adjacent edges of arms 17A and 17B of respective spiders 14 and 13. The brackets with the insulating pad therebetween are bolted together by bolt and nut unit 33. As shown in FIGS. 5*b* and 5*c*, the bolt used to mechanically connect the two brackets together is electrically isolated therefrom by a nylon or insulative sleeve 34 and a pair of washers 35 and 36 each made of an insulative material.

Figure 6:
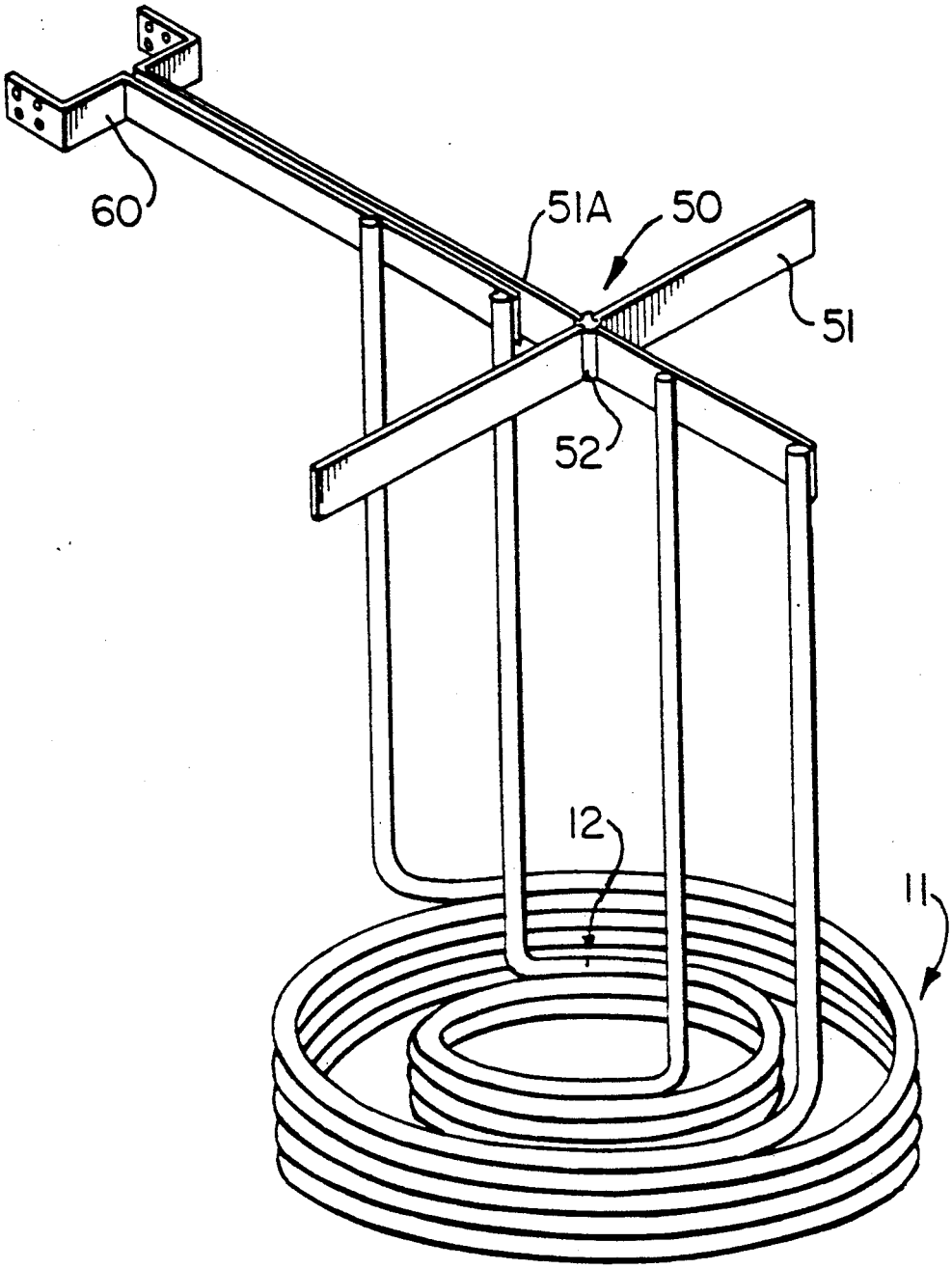
FIG. 6 is an oblique partial view similar to FIG. 2*c* but illustrating a modified spider arrangement for one end of the reactor.

FIG. 6 illustrates a simpler alternative arrangement which may be used at one end only of the reactor. Here a single spider 50 having a plurality of arms 51 radiating from a central hub 52 is used in conjunction with a parallel stub arm 60 which is physically alongside and supported by arm 51A of the spider, but electrically isolated therefrom. Arm 51A has terminal B and stub arm 60 has terminal A. One of the helices of each package 11 and 12 (as in FIG. 2*c*) is terminated on the stub arm 60, while the other is terminated on an arm of the spider 50, which is physically 180° away from the stub arm 60. This artifice insures that adjacent points on conductors of the two helices of each package differ by one half of a turn voltage, as in the case where two full spiders are used, as previously described. It should be noted that the arrangement of FIG. 6 may be used at only one end of the reactor. In general, each package of the reactor must have a different number of turns (not normally an integral number of turns) in order to cause the required current division among the packages. Thus, although the two helices of all packages are connected to two common points at one end of the reactor, as shown in FIG. 6, the other ends of the helices must terminate on various arms as shown in FIG. 2*c*. As shown in FIG. 2*c*, the ends of the two helices in any package terminate on different spiders at points 180° from each other.

Figure 6A:
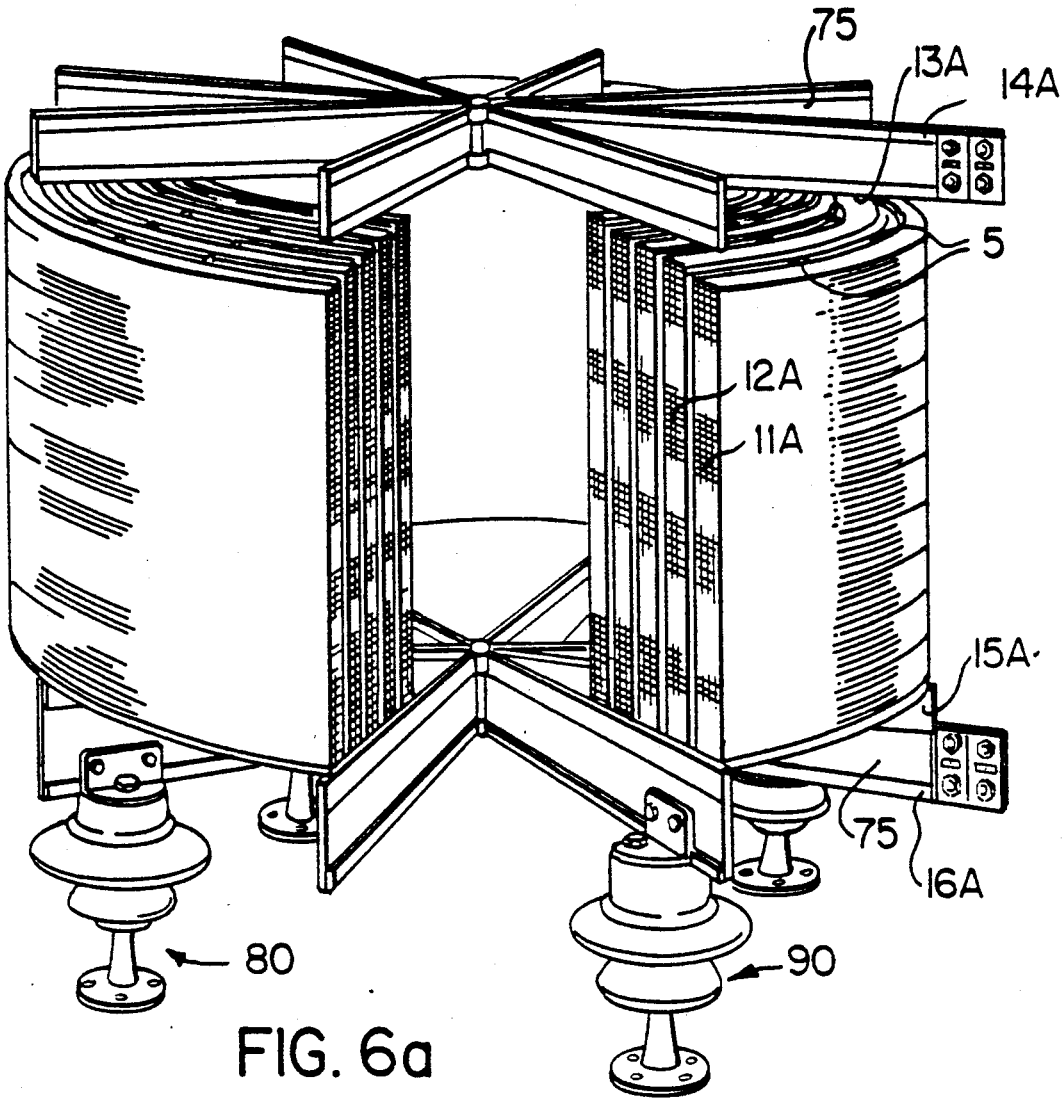
FIG. 6A is an oblique partial cut-away view of an air core reactor with more detail than in FIG. 2*a* and illustrating a modified construction for the pairs of spiders at each end.
Figure 6B:
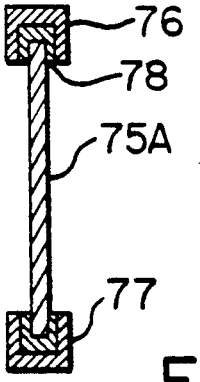
FIG. 6B is a cross-section of one spider arm illustrating a still further modification for the construction of the spider.

FIGS. 6A and 6B illustrate further physical means of providing the equivalent of two spiders and comprise essentially one structural member with two separate electrically conductive spiders mounted thereon and carried thereby. FIG. 6A additionally illustrates in partial section the physical structure of an air core reactor incorporating the present invention.

Referring to FIG. 6A, there is illustrated a plurality of coil packages, the two outermost of which are designated 11A and 12A, and are equivalent to coil packages 11 and 12 of FIG. 2*c* or packages l, k, n of FIG. 4. Each coil package 11A and 12A, however, differ from coil packages 11 and 12 in that they have a number of layers of windings radially one outside the other with adjacent layers abutting but electrically insulated from one another. Each layer has two or more helical windings wound one on top of the other as shown in FIG. 2*c*, and designated therein H1 and H2. Each coil package 11A and 12A is a rigid unit of glass reinforced plastics material having the coil layers embedded therein. The coil packages are radially spaced from one another by spacers S, which thus provides a plurality of vertical cooling ducts.

As in FIG. 2*c*, there are two electrical spiders at the top designated respectively 13A and 14A, and two at the bottom designated respectively 15A and 16A. In this embodiment, however, spiders 13A and 14A are supported by one structural member designated 75. This structural member can be an insulative material with spiders 13A and 14A made of electrically conductive material mounted directly thereon, or alternatively if member 75 is electrically conductive then spiders 13A and 14A are mounted thereon but separated therefrom by an insulative material. Spiders 15A and 16A at the bottom are similarly mounted on a rigid structural member 75. The air core reactors of FIGS. 6A and 2*a* are the same differing only in construction of the spiders and the mounting bases. The reactor of FIG. 6A is supported on insulator bushings 90 attached directly to the arms of the bottom spider.

In FIG. 2*a*, in addition to this, there is a glass fiber reinforced plastics material base 80.

FIG. 6B is a cross-section through one spider arm of the general type of spider shown in FIG. 6A. In FIG. 6B the rigid member 75A of the spider is metal, for example stainless steel, and the electrical conductive portion of the spiders for connecting the coils in parallel is a pair of channel pieces designated 76 and 77. These channel pieces are electrically conductive and insulated from member 75A by an insulator member 78. In this embodiment, one of the bottom spiders, i.e. 15A in FIG. 6A, is provided by interconnecting at the hub all of channel pieces 76 carried by the arms of rigid member 75A. Similarly, the spider 16A associated with spider 15A is provided by interconnected all of channel pieces 77 at the hub on the lower part of the rigid member 75A.

Obviously the double spiders can take other physical forms depending upon the structural requirements of the unit in question.

THE USE OF A DOUBLE SPIDER AT ONE END ONLY

A less sensitive system, but less expensive, will result if a double spider is used at one end only of the reactor. The sensitivity of this system may be seen by considering again the results of Table 1. For a fault near the mid-plane of the coil, the results of cases 1 and 2 are valid if one uses the results for one detector only. For these faults, the simpler system is half as sensitive as the system where double spiders are used and the two detector signals added. For the case of a fault very close to the double spider, the results in Table 1 for cases 3 and 4 apply if one uses the currents in the top detector only. For this case, the simpler system has virtually the same sensitivity as the system with double spiders at both ends. For the case of a fault near the end of the reactor remote from the double spider, the results in Table 1 for cases 3 and 4 apply if one uses the currents in the bottom detector only. In this case, the sensitivity is severely reduced compared to the full system. This is especially unfortunate since the fault current is very much larger than the detector current. The double spider used may be constructed as described hereinbefore and illustrated in the drawings.

Figure 7:
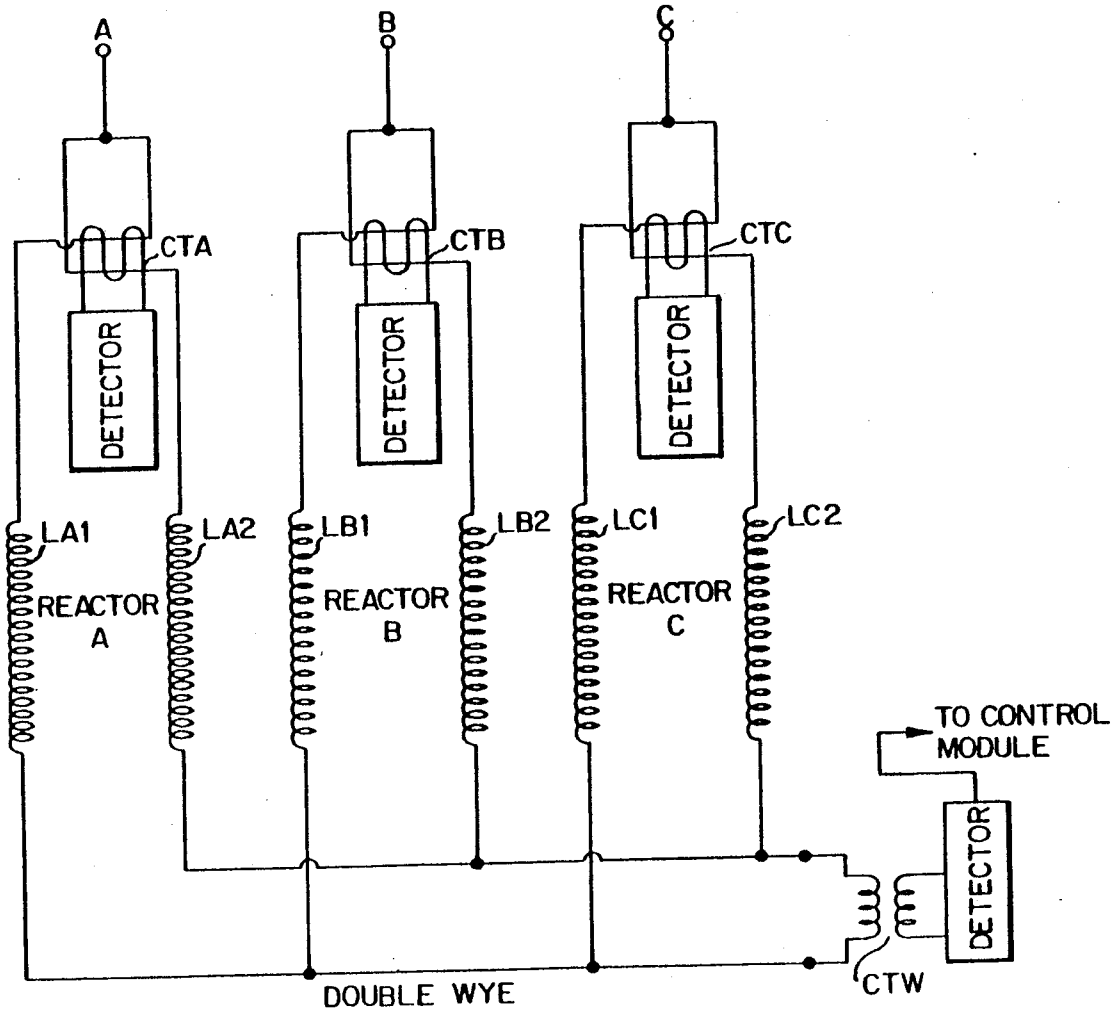
FIG. 7 is a schematic view of 3-phase wye connected reactors with a fault detector system of the present invention.

PROTECTION OF 3-PHASE REACTOR BANK

Where a 3-phase wye-connected bank of reactors is to be protected, a modified scheme may be used as shown schematically in FIG. 7. In this figure, there are three reactors designated A, B and C, and the two halves of each reactor are shown for simplicity as a single inductance rather than as "n" inductances in parallel, where "n" is the number of packages in the reactor. In, for example, reactor A the single inductance of one half is designated LA1 and the other half as LA2. Each reactor is equipped with double spiders at each end. The spiders at the line end of each reactor are connected to a differential current transformer discussed in the previous section and designated in FIG. 7 as CTA, CTB and CTC. The three sets of double spiders at the other end are connected to form a double wye, and a simple current transformer designated CTW is connected between the two halves of the double wye. This reduces the sensitivity of the wye-end detector slightly but has the advantage that only four instead of six current transformers and detectors are required. The foregoing described current transformers as shown each have a detector associated therewith.

ADVANTAGES OF THE NEW FAULT DETECTION SYSTEM

The advantages of the new fault detection system over those presently being used for air core reactors are the following:

(1) Since the fault detection scheme detects faults by comparing the currents into two halves of the reactor, it is necessary that these two currents be virtually identical under unfaulted conditions. Because the special construction used in the protection system disclosed herein, namely the use of two, identical, interwoven helices in each package (or 2n, where n is an integer), ensures that the two halves of the reactor are virtually identical, therefore the residual difference in currents in the two reactor halves under balanced conditions is very, very small. This is necessary in order to detect very small faults in the reactor.

(2) Because of the sensitivity, small faults may be detectable long before any damage is done either to the reactor or to connected equipment. Because the detector signals are proportional to the fault, the faults are easily detected and the coil can be disconnected very quickly.

(3) Because, in the preferred embodiment, double spiders are used at both ends of the coil and each of the interwoven helices in every package is connected to a different set of spiders, it is very easy to check in a foolproof manner for faults in the completed reactor before it leaves the factory and at any time in the field simply by disconnecting the double spiders at each end and applying a high potential direct voltage between the two halves of the coil. Because of the unique construction, any fault will result in a connection between the two halves which is easily detectable. Furthermore, the exact location of the fault may be found by disconnecting the two helices of each package in turn and performing a continuity test to see if a connection exists between them, which indicates a fault. Once the fault has been located in a certain package, the exact position of the fault can be detected by measuring the resistances between the top ends and the bottom ends of the two helices comprising the package.

(4) Because of the great sensitivity and reliability of the fault detection system it is possible to protect all types of reactors including those which were hitherto very difficult to protect, for example smoothing reactors. The main current in smoothing reactors is direct current and it is very difficult to apply any protection system to these coils. However, since DC smoothing reactors always contain alternating ripple currents the present system is directly applicable to protecting these reactors. Furthermore, the reliability and sensitivity of the system allows reactors to be employed in a more optimum manner in some circumstances, for example in VAR protection systems. It has been traditional in these systems to build the reactor in two completely separate pieces and to connect the sensitive power semi-conductor circuits between the two halves of the reactor in order to protect them. Using the present system, a single reactor (which is considerably cheaper) may be used since the sensitivity and reliability of the system can guarantee that a reactor fault will be detected before damage can be done.

In the foregoing there is described, with reference to the drawings, what in general may be described as an air core reactor with two or more coaxial concentric coils connected in parallel using a single structurally rigid and electrically conductive spider at one end, and a structurally rigid and two electrically conductive spiders at the other end. The two electrically conductive spiders can be mounted on one structurally rigid spider unit, or there can be two separate structural units. In the preferred form, there are two spiders at each end and all packages are wound with at least two internested helices, and connections of such helices to the spiders are offset circumferentially. This provides an apparatus that can be readily checked for minor faults, or alternatively the existence of a fault can be used to initiate a shut down of a system or part of a system in which the reactor is used.

Physically rigid spiders have been described which are electrically conductive and mounted on top of one another or internested. As an alternative, the rigid structural part may be one structural member and two electrical spider parts mounted thereon.

The embodiments of the invention in which an exclusive property or privilege is claimed are defined as follows:

1. An air core reactor comprising a plurality of coaxial helical coil windings, an electrically conductive and structurally rigid first spider at one end of said coil windings and two electrically conductive second and third spiders electrically insulated from one another at the opposite end of said coil windings, said coil windings being connected at said one end to said first spider and at said opposite end to said second and third spiders, a selected number of said coil windings being connected only to said second spider and the remaining ones connected only to said third spider.

2. An air core reactor as defined in claim 1, wherein the windings that are connected to said second spider are connected thereto at a position circumferentially offset around the coaxial coil windings from where said remaining coil windings are connected to the third spider.

3. An air core reactor as defined in claim 1 including a fourth spider associated with and electrically insulated from said first spider whereby there are two coaxial coils, said selected number of coil windings being connected only to said first spider and said remaining coil windings being connected only to said fourth spider.

4. An air core reactor as defined in claim 1, wherein at least some of the coil windings are interwoven at least two conductors high with the same number of turns and wherein the ends of said two conductors are circumferentially offset from one another.

5. An air core reactor comprising a plurality of coaxial, concentric, coil packages radially spaced from one another providing air cooling passages therebetween extending lengthwise of the reactor, each said coil package comprising at least one winding layer of two or more conductors wound helically at the same time one on top of the other, said conductors being electrically insulated from one another, a first rigid spider at one end of said coil packages, a second and a third rigid spider at the opposite end of said coil packages, each of said spiders having electrically connected, electrically conducting arms radiating outwardly from the axis of the coil packages, means electrically insulating the electrically conducting arms of said second and third spiders from one another, means typing together said spiders at opposite ends of the coils providing a physically rigid air core reactor unit, said helical coil windings being connected at opposite ends to said spiders at opposite ends of said reactor unit with a selected number of said helical windings connected at said opposite end to only said second spider and the remaining at such end connected only to said third spider.

6. An air core reactor as defined in claim 5 including a fourth spider, at said one end of said coil packages, associated with and electrically insulated from said first spider whereby there are two spiders at each of opposite ends of the coil packages.

7. An air core reactor as defined in claim 1, wherein said second and third spiders at said opposite end of the reactor comprise respectively a first set of electrically interconnected, electrically conducting arms radiating outwardly from the axis of the coaxial coils and a second set of similar arms electrically insulated from said first set and means structurally rigidly supporting said electrically conducting arms.

8. An air core reactor comprising two or more cylindrical coaxial concentric coil packages electrically connected in parallel and each having helical coil windings characterized in that at least one coil winding in at least one of said packages has at least one multiple of two interwoven helical windings, in that said two interwoven helical windings are of an equal number of turns but with their beginnings and endings of the windings offset circumferentially around the reactor from one another and further characterized in that two spiders, electrically insulated from one another, are located at each of opposite ends of the cylindrical coil packages, a first selected number of said helical windings being connected at respective opposite ends to one of said spiders at the opposite ends of the reactor and the remaining connected to the other spiders at said respective opposite ends.

9. An air core reactor as defined in claim 8, characterized in that each of said coil packages has at least one coil layer and wherein each of said coil layers has at least one multiple of two interwoven helical windings and in each instance such interwoven helical windings have an equal number of turns but are rotationally offset relative to one another about the axis of the reactor.

10. An air core reactor comprising at least two coaxial concentric coil packages disposed in radial spaced relation, each said coil package comprising one or more layers of at least one multiple of two insulated conductors, said at least one multiple of two conductors being helically wound at the same time providing interwoven helical windings having the same number of turns but wherein one is rotationally offset from the other about the axis of the reactor and means connecting all of said helical windings to one terminal at one end of the reactor and first and second spider means connecting all of said helical windings to a second terminal at an opposite end of the reactor, means electrically insulating said first and second spider means from one another, means electrically connecting a selected number of said helical windings to said first spider means electrically connecting the remaining helical windings to said second spider means.

11. An air core reactor as defined in claim 10, wherein said helical windings of a common layer are rotationally offset from one another by 180°.

12. An air core reactor as defined in claim 10 wherein each of said coil packages comprise one or more layers of winding embedded in a reinforced rigid plastics material.

13. An air core reactor as defined in claim 10 including means radially separating one coil package from another.

14. An air core reactor as defined in claim 10, wherein said means connecting said helical windings to said terminal at said one end of said reactor comprises a third and fourth rigid spider at said one end, and wherein said selected number of helical windings are electrically connected only to said third spider and the remaining are electrically connected to said fourth spider.

15. An air core reactor comprising:

(a) a plurality of coaxial, co-extensive, helical coil windings, (b) a first pair of spider units at one end of said coil windings, (c) means electrically insulating one such spider from the other in said first pair of spiders, (d) a second pair of spider units located at an opposite end of said coil windings, (e) means insulting one such spider from the other in said second pair of spider units, each said spider unit having a plurality of electrically conducting arms radiating outwardly from the axis of said coil windings permitting connecting the coil windings thereto at selected positions spaced circumferentially around the reactor unit, (f) means connecting the respective opposite ends of a selected number of said coil windings to a respective one spider unit in said first and second pair of spider units and means connecting the opposite ends of the remaining coil windings to the other of said spider units of said first and second pairs of spider units.

16. An air core reactor as defined in claim 15, wherein said selected number of coil windings and said remaining coil windings are connected to the respective spiders at positions circumferentially offset from one other around the reactor.

17. A reactor as defined in claim 16, wherein said offset is 180°.

* * * * *